US005360123A

United States Patent [19]

Johnston

[11] Patent Number: 5,360,123

[45] Date of Patent: Nov. 1, 1994

[54] GANTRY STABILIZER

[75] Inventor: Roger L. Johnston, Muskego, Wis.

[73] Assignee: J&R Engineering Company, Inc., Big Bend, Wis.

[21] Appl. No.: 27,185

[22] Filed: Mar. 5, 1993

[51] Int. Cl.[5] ..... B66C 5/02

[52] U.S. Cl. ..... 212/140; 104/126; 212/208; 212/218; 267/168; 267/286

[58] Field of Search ..... 212/208, 218, 219, 140, 212/141, 142, 220; 104/126; 267/166, 168, 170, 180, 286

[56] References Cited

U.S. PATENT DOCUMENTS

| | | | |
|---|---|---|---|
| 1,329,561 | 2/1920 | Thompson | 267/286 |
| 2,643,109 | 6/1953 | Wood | 267/180 |
| 4,381,839 | 5/1983 | Engler et al. | 212/208 |

FOREIGN PATENT DOCUMENTS

| | | | |
|---|---|---|---|
| 2567115 | 1/1986 | France | 212/218 |
| 476383 | 12/1926 | Germany | 104/126 |
| 702409 | 1/1941 | Germany | 212/140 |
| 591392 | 2/1978 | U.S.S.R. | 212/218 |
| 688419 | 10/1979 | U.S.S.R. | 212/208 |

*Primary Examiner*—Michael S. Huppert
*Assistant Examiner*—Thomas J. Brahan
*Attorney, Agent, or Firm*—Reinhart, Boerner, Van Deuren, Norris & Rieselbach

[57] ABSTRACT

An apparatus and method for stabilizing a gantry. Powerful springs in the apparatus allow small deviations from a perpendicular configuration of a boom and beam arrangement. The springs resist larger deviations, thereby increasing the structural integrity and safety of the apparatus and method. The method stabilizes the gantry by providing a progressively increasing restoring force as the boom and beam travel farther from a starting position corresponding to a perpendicular relationship between the boom and the beam.

8 Claims, 8 Drawing Sheets

Fig. 11
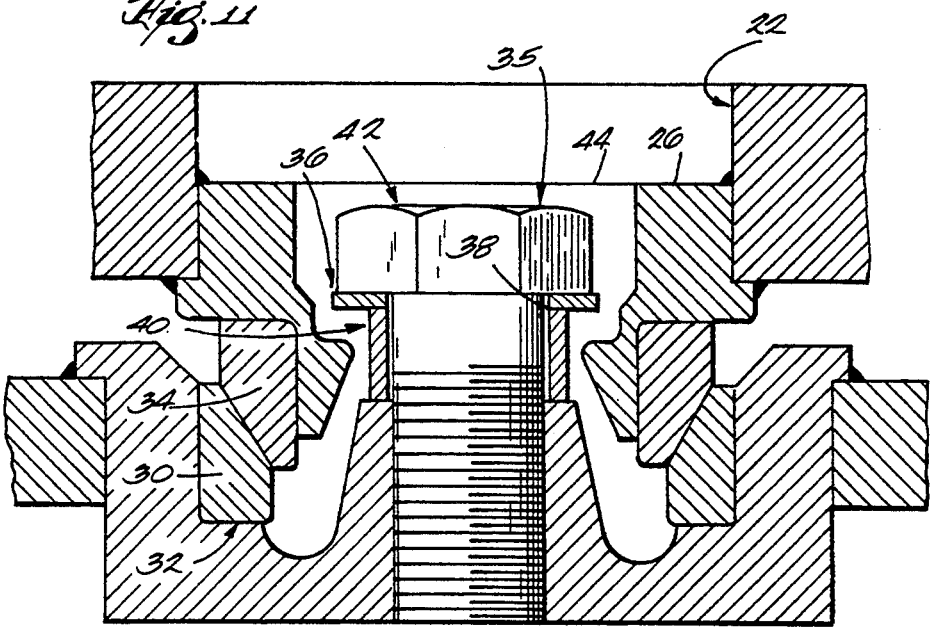
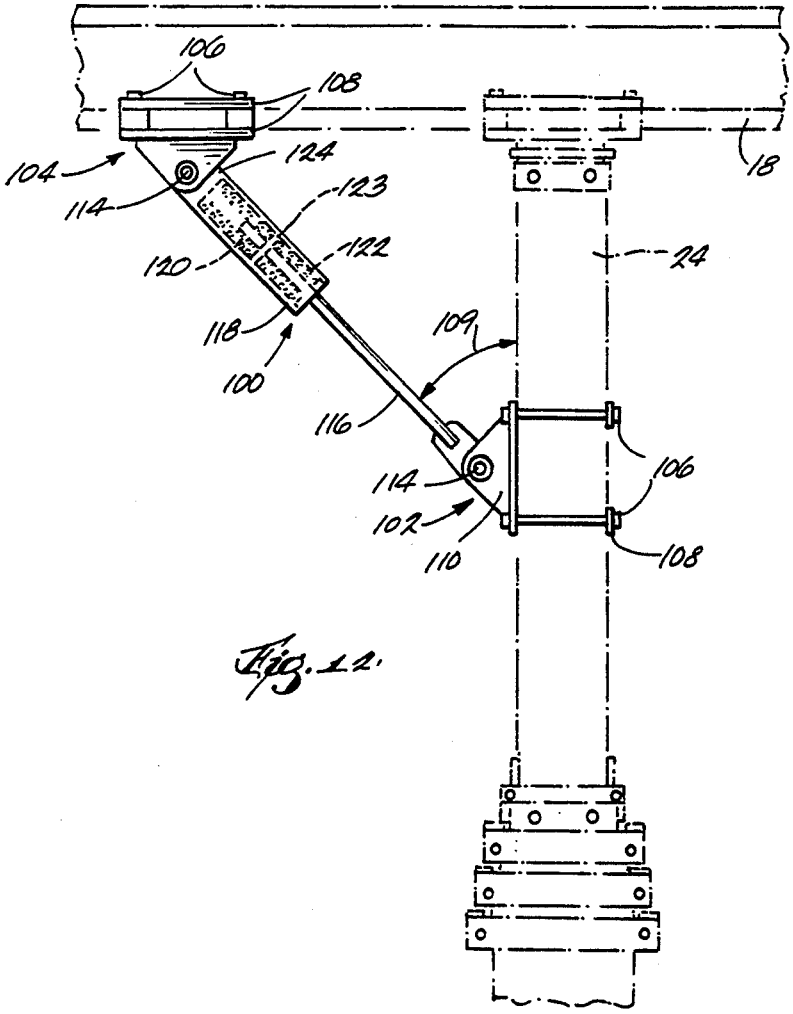
Fig. 12.

Fig. 19
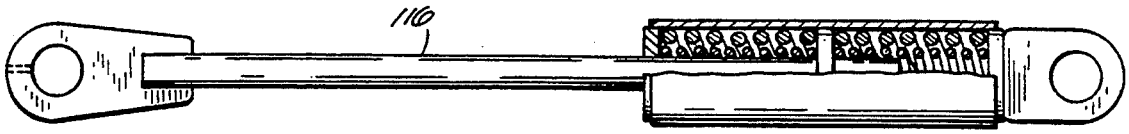
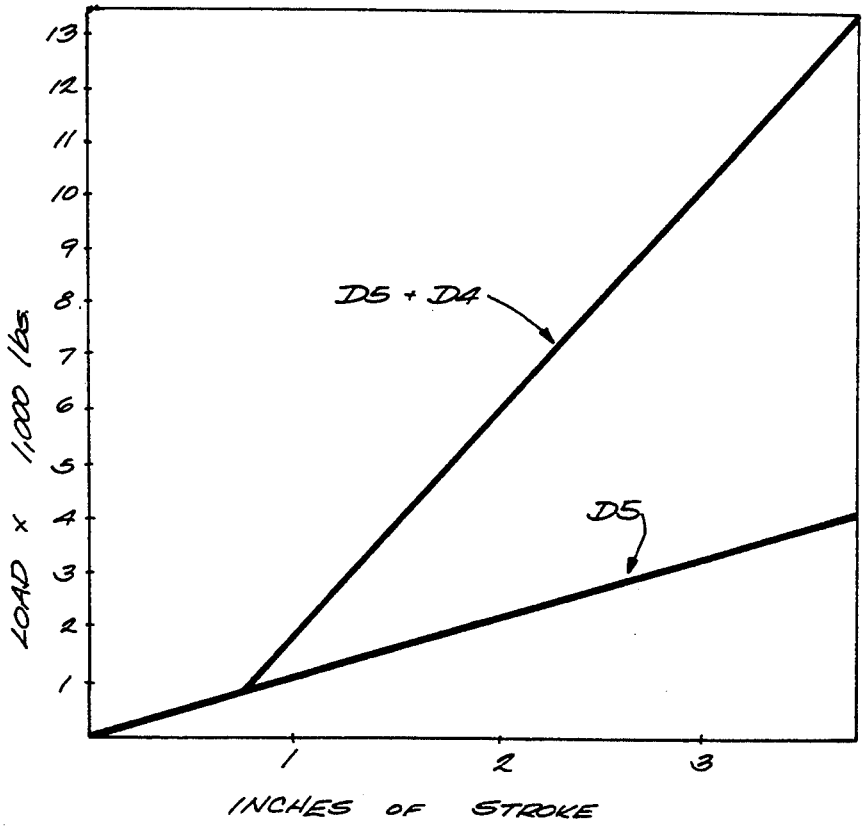
Fig. 22.

GANTRY STABILIZER

BACKGROUND OF THE INVENTION

This invention relates generally to an apparatus and method for stabilizing lifting equipment and, more particularly, to an apparatus and method for stabilizing an extendible boom gantry.

One particularly versatile kind of lilting apparatus is the type having an extendible boom supported by vertical extendible boom structures. Such an apparatus, which is exemplified by the extendible gantry lifting apparatus manufactured and distributed by J&R Engineering Company, Inc., of Big Bend, Wis., is described in U.S. patent application Ser. No. 07/971,333 filed Nov. 4, 1992. Such an apparatus provides a machine that can lift large loads to substantial heights and transport them horizontally. In many ways, the versatility of the machine is limited only by the imagination of the operators and riggers who call upon the machine to perform various tasks.

When substantial loads are being raised, safety requires that any potential stability problems be avoided. One possible stability problem can occur when one boom travels farther than another causing misalignments of the extendible booms. Another possible problem can occur when uneven loading or other stresses cause the relationship between the beam and the extendible booms to deviate from perpendicular. Similarly, the extension of two hydraulic cylinders and the operation of two sets of driving wheels must be precisely coordinated. Any such lack of coordination can cause structural failure, particularly when a rigid gantry structure is attached to these mechanisms. Accordingly, means for allowing slight misalignments while retaining the structural integrity of the gantry structure are critically needed.

SUMMARY OF THE INVENTION

One form of the invention provides a stabilizing apparatus and method for a gantry having stiff springs mounted substantially within a barrel which is pivotably connected between a boom and beam of the gantry.

Another form of the invention also provides a plurality of stiff springs within the barrel to provide progressive restoring force to the beam and boom to which it is attached.

It is therefore an object of the invention to provide a new and improved apparatus and method for stabilizing a lifting apparatus.

It is still another object of the invention to provide an improved apparatus and method for stabilizing a lifting apparatus having an extendible boom.

It is yet another object of the invention to provide a novel apparatus and method for stabilizing a vertically extendible gantry structure.

It is still another object of the invention to provide a vertically extendible gantry having an improved stabilizing connection between a beam and extendible legs which allows slight misalignment of the legs while preventing large misalignments which can result in structural instability.

It is still a further object of the invention to provide a novel stabilizing apparatus and method that allows structural components of a lifting apparatus to shift slightly while progressively preventing deviation sufficient to cause structural weakness or failure.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in conjunction with the accompanying drawings, wherein like-referenced numerals identify like elements, and wherein:

FIG. 11 is an expanded cross-sectional view of the header plate in a neutral position:

FIG. 12 is a side elevation view of a stabilizer bar assembly constructed in accordance with one form of the invention shown coupled to a beam and boom of a gantry;

FIG. 15 is a side elevation view of a single spring stabilizer bar assembly constructed by assembling the components shown in FIGS. 13 and 14;

FIG. 19 is a side elevation view of an alternative embodiment of a dual spring stabilizer bar;

FIG. 22 is a plot of loading versus inches of stroke for a dual stabilizer bar structure constructed in accordance with one form of the invention.

DESCRIPTION OF THE PREFERRED EMBODIMENTS

Figure 1:
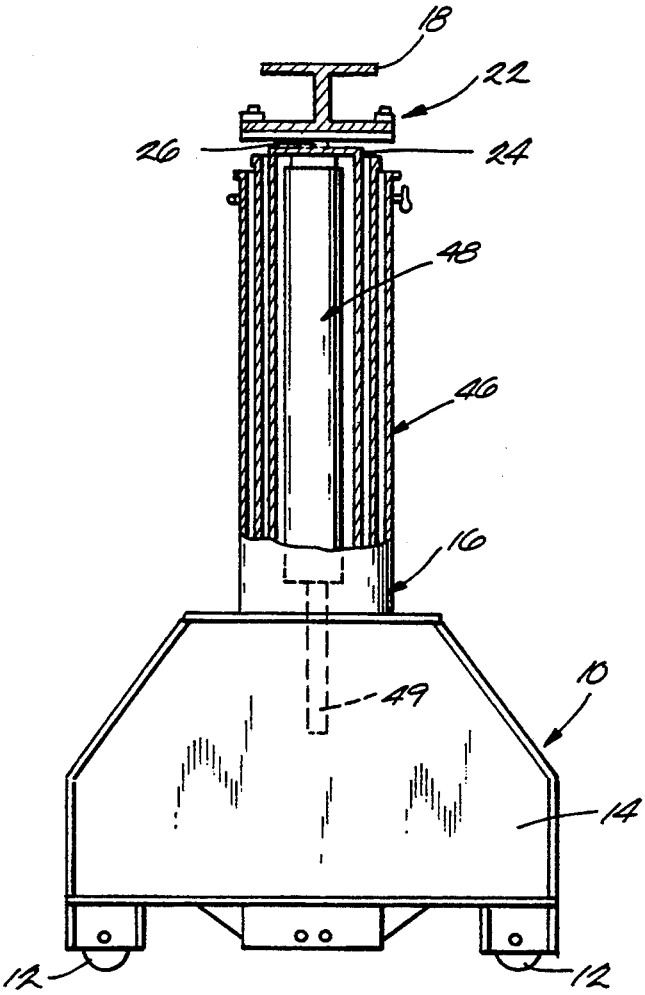
FIG. 1 is a front elevation view of a gantry constructed in accordance with one aspect of the present invention in its fully lowered configuration, having cross-sectional details of an extendible portion of the boom assembly shown.

Referring to the drawings, a hydraulic boom gantry 10 constructed in accordance with one aspect of the invention is shown in FIGS. 1–8.

As illustrated, the hydraulic boom gantry 10 includes a base 14 carried on two sets of wheels 12. One or more lifting legs 16 are attached to each of the bases 14. A beam 18 is connected to the top of the lifting legs 16. Various rigging devices 20 may be mounted on the beam 18, which, in turn, is supported by the lifting legs 16 and the bases 14. The rigging devices 20 can include conventional chains, cables or the like that can be used to connect the load to the beam 18 or can include a powered rigging device (not shown).

Figure 9:
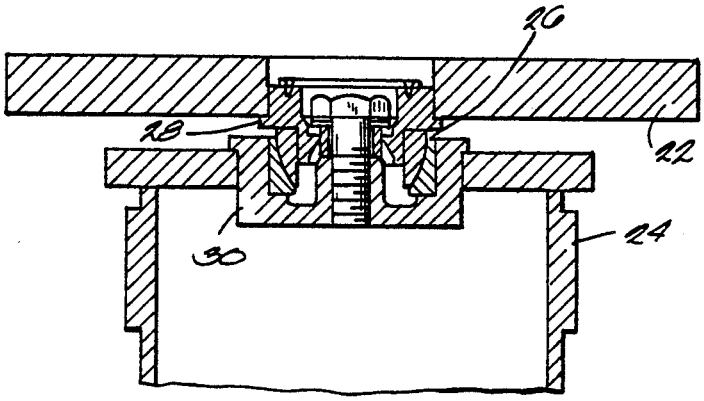
FIG. 9 is a cross-sectional view of a header plate constructed in accordance with one form of the invention in a neutral position.
Figure 10:
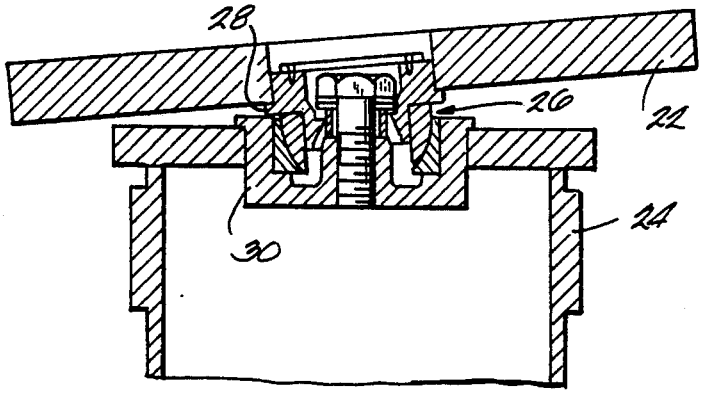
FIG. 10 is a cross-sectional view of the header plate in a fully tilted position;.
Figure 25:
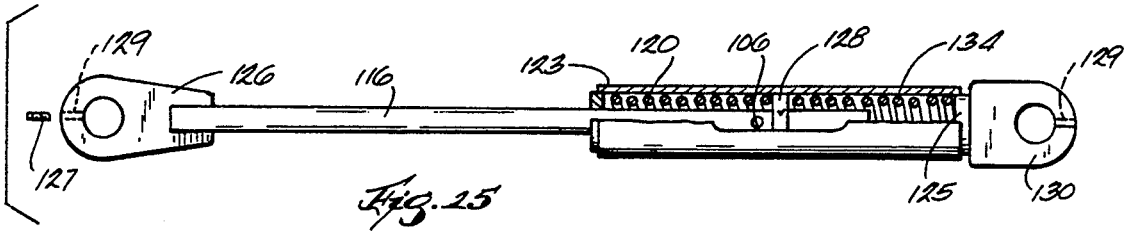

The bases 14 and lifting legs 16 are kept in substantially parallel alignment with one another by the beam 18 and a header plate structure 22. Preferably, a swiveling header plate 22 is used to connect the beam 18 to a manual boom section 24. As shown in FIGS. 1–11, the swiveling header plate 22 comprises a hemispherical bearing 26. The bearing 26 is mounted so as to allow relatively small differences in height between the lifting legs 16 and relatively small misalignments of the bases 14. Larger misalignments are limited in part by the clearances around the bearing 26 as shown in FIGS. 9–11. As a larger deviation starts to occur, it is limited by binding contact between the upper bearing structure 28 and the outer bearing cup exterior 30. The clearance between the upper bearing structure 28 and the outer bearing cup exterior 30 can be varied with plates, shims or the like to vary the amount of unchecked deviation. A stabilizer bar assembly 100 constructed in accordance with one aspect of the invention also limits larger misalignments by generating progressively larger restoring forces as misalignment increases. Various preferred embodiments of the stabilizer bar assembly 100 are described in greater detail below.

As shown in FIGS. 9–11, the hemispherical bearing 26 comprises components located in and between the top of the manual boom section 24 and the header plate 22. The manual boom section 24 includes an outer bearing cup 30 which is pressed into place in a pocket 32. The header plate 22 includes an inner bearing cone 34 pressed into place over the upper bearing structure 28. After the header plate 22 and the inner bearing cone 34 are positioned in the outer bearing cup 30 of the manual boom section 24, a connecting bolt assembly 35 is used to retain the header plate structure 22 in an operating configuration. A spacer 36 is placed over the threaded hole 38 of the outer bearing cup 30. Next, a washer 40 is placed over the spacer 36 and a bolt 42 is inserted into the threaded hole 38 and tightened securely. Finally, a cover plate 44 is bolted into place over the top of the bolt 42 head. In this way, the lifting legs 16 are securely fastened to the beam 18 while still allowing minor misalignments to occur without causing structural failure.

Extension of the lifting legs 16 permits lifting of the load by the beam 18 and rigging devices 20 as desired. The lifting legs 16 comprise telescoping boom sections 46 preferably made of square structural tubing. Though it will be readily apparent to one skilled in the art that various materials may be used for the hydraulic boom gantry 10 components, steel is preferably used. Though the number of telescoping boom sections 46 used in a particular hydraulic boom gantry 10 can be varied, a hydraulic boom gantry 10 having three telescoping boom sections 46 is shown in the Figures for illustrative purposes.

Although various pressurized cylinder means can be used, a hydraulic cylinder 48 is described for illustrative purposes. A conventional multiple telescoping stage hydraulic cylinder 48 mounted in an inverse orientation is preferably disposed within the interior of the telescoping boom sections 46 as shown in FIG. 1. The hydraulic cylinder 48 is supplied with pressurized fluid through its rod 49 in a conventional manner. The preferred inverse orientation of the cylinder 48 places the input and output ports of the cylinder 48 at a stationary position at the bottom of the lifting legs 16. Thus, complex hydraulic hose reels are not required to accommodate additional hydraulic hose length when the cylinder 48 extends and retracts. It will be apparent to one skilled in the art that the cylinder 48 can be oriented opposite this configuration and can use hydraulic hose reels as described. However, maintenance problems associated with the hose reels can be avoided in the preferred embodiment.

The inverse cylinder 48 orientation also provides greater and more consistent bending moment resistance throughout the boom structure 10 by matching the weakest and smallest boom sections 46 (the manual 24 and the first powered 50 sections) with the strongest portions of the cylinder 48 (the barrel 52 and the first stage 54). Further, in the preferred embodiments described herein, the joints of the hydraulic cylinder 48 are offset from the joints of the boom sections 46, thus providing greater bending moment resistance by preventing overlap of these high-stress areas. In addition, any air which enters the hydraulic cylinder 48 rises to the top of the barrel portion 52 (in its inverse orientation) where it may be easily purged from the cylinder 48. As the cylinder 48 is extended under pressure from a conventional hydraulic pump, the telescoping booms 46 can be extended from a fully retracted position.

Another preferred embodiment of the invention, having lifting legs 16 which include a manual boom section 24, a first powered section 50 and a second powered section 56, is described for illustrative purposes. In FIG. 3–8 it will be apparent to one skilled in the art that the stabilizer bar assembly 100 described herein can be used with nonextendible gantries as well as extendible gantries.

Figure 3:
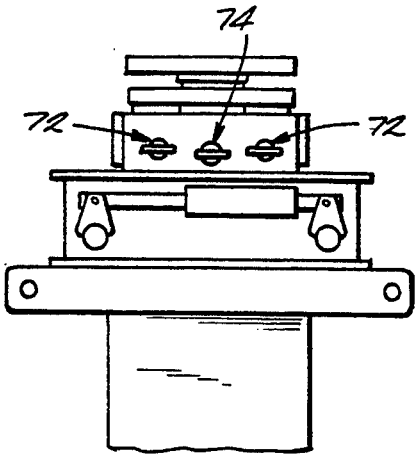
FIG. 3 is a front elevation view of a boom assembly with boom pins and cylinder pin in place.

Each lifting leg 16 is provided with two boom pins 72 and one cylinder pin 74 as shown in FIG. 3. The two boom pins 72 are located on either side of the cylinder pin 74 as shown. Though various diameters may be used, in the illustrated embodiment the cylinder pin 74 is preferably 1.75 inches in diameter and the boom pins 72 preferably have diameters of 1.5 inches.

Figure 4:
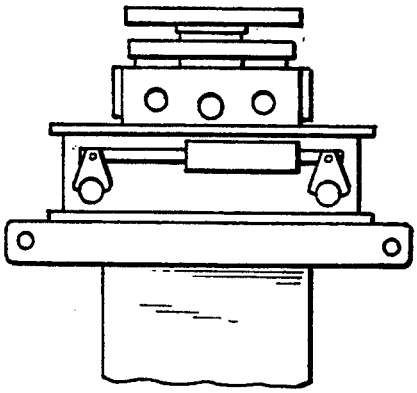
FIG. 4 is a front elevation view of a boom assembly in its fully retracted position with the boom and cylinder pins removed.
Figure 2:
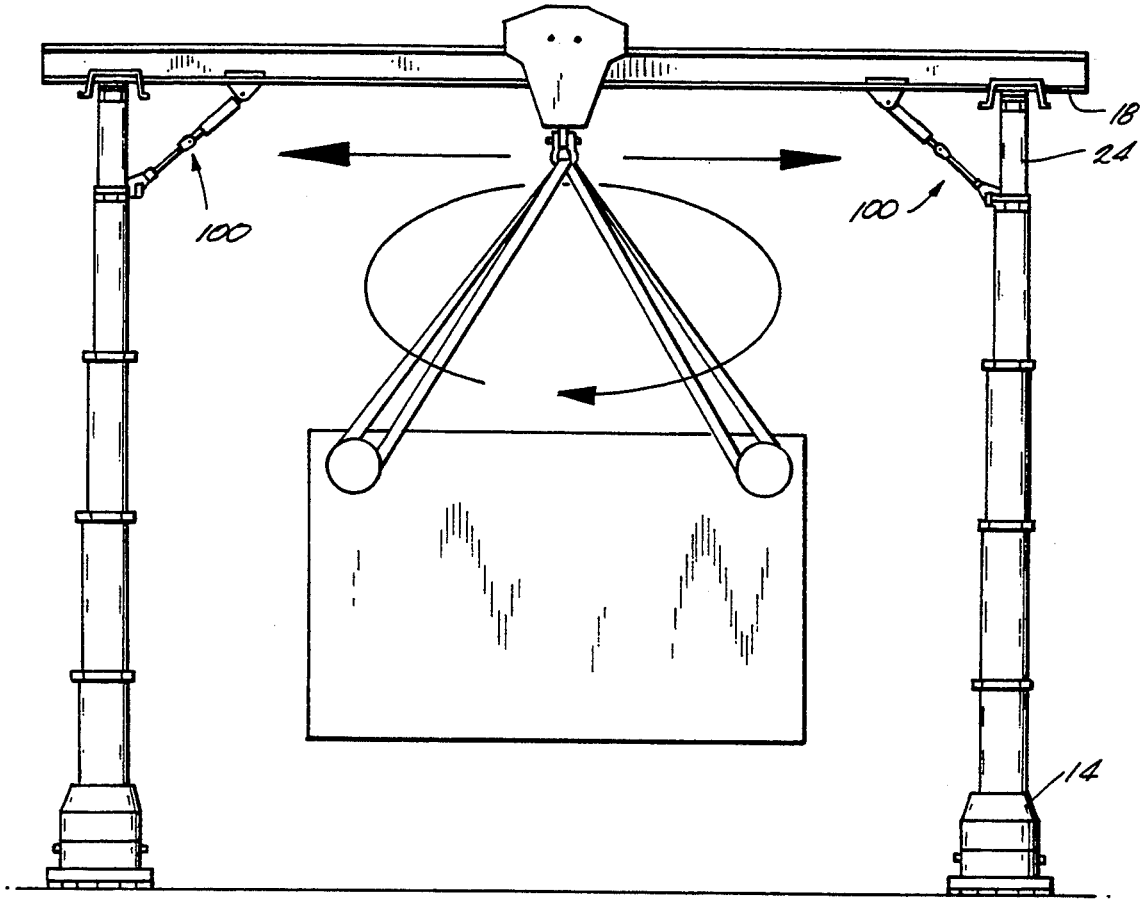
FIG. 2 is a side elevation view of the boom assembly in a fully extended manual section configuration showing a stabilizer bar constructed in accordance with one form of the invention.
Figure 5:
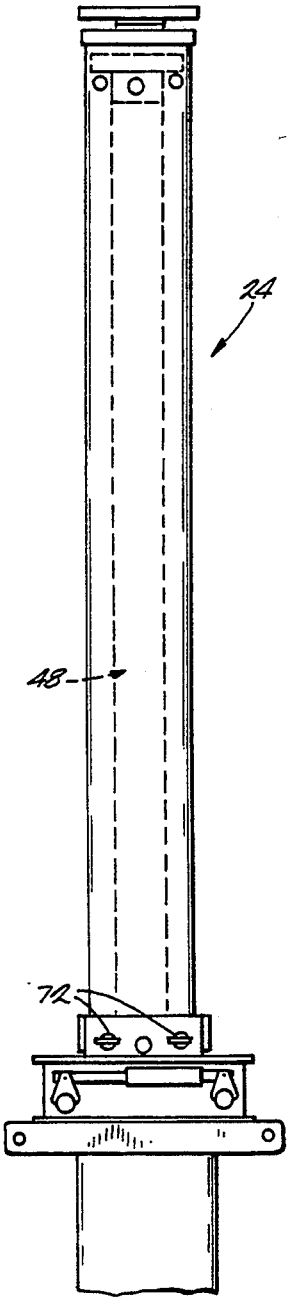
FIG. 5 is a front elevation view of boom assembly with the manual section extended before pin insertion.
Figure 6:
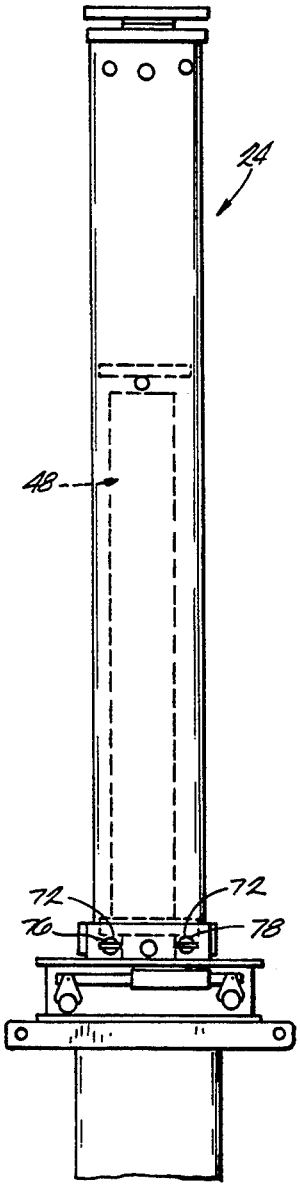
FIG. 6 is a front elevation view of a boom assembly with the manual section pinned in place by the boom pins and hydraulic cylinder partially retracted.
Figure 7:
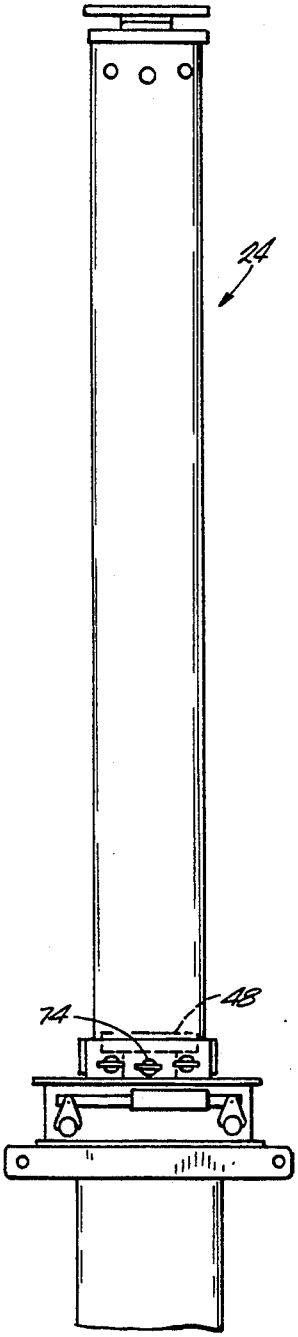
FIG. 7 is a front elevation view of the boom assembly with the manual section fully extended and locked in place with the boom and cylinder pins.
Figure 8:
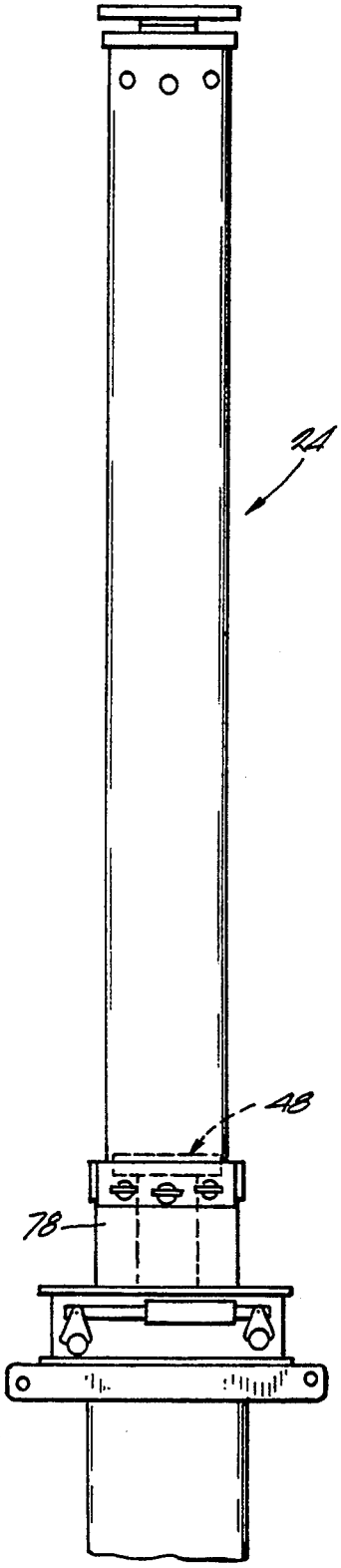
FIG. 8 is a front elevation view of the boom assembly with the manual section pinned in place and a hydraulic cylinder lifting the first stage section and the manual section therewith.

The boom sections 46 are extended as follows: First, while the boom sections 46 are fully retracted, the boom pins 72 and the cylinder pin 74 are removed as shown in FIG. 4. In some instances, the hydraulic cylinder 48 may need to be extended slightly to remove binding pressure from the cylinder pin 74. Next, the hydraulic cylinder 48 is extended. The first manual section 24 is extended coordinately with the hydraulic cylinder 48. If extension greater than the height provided by manual section 24 extension is desired, the hydraulic cylinder 48 is fully extended until the boom pinning holes 76 become aligned with the first stage section pinning holes 78 as shown in FIG. 10. Once the boom pinning holes 76 are aligned, the boom pins 72 are fully inserted in the boom pinning holes 76. This locks the first manual section 24 in place. The hydraulic cylinder 48 may then be retracted within the first manual section 24 as shown in FIG. 6. The hydraulic cylinder 48 is retracted until a cylinder pinning hole 80 is aligned with the first stage section cylinder hole 78 and a cylinder pin 74 is inserted as shown in FIG. 7. Hydraulic cylinder 48 extension now coordinately raises the first stage section 54 and the first manual section 24 pinned thereto. Additional stage extension is performed in the same manner.

Retraction of the stages is performed as follows: the first stage section 54 is retracted with the hydraulic cylinder 48 until the cylinder pin 74 is freed from binding pressure. The cylinder pin 74 is then removed and the hydraulic cylinder 48 is extended as needed to free the boom pins 72 from binding pressure. The boom pins 72 are then removed and the hydraulic cylinder is retracted until both the boom pin holes 76 and the cylinder hole 80 are aligned with the holes in the first stage section 78. The manual section 24 is retracted in the same fashion.

In both preferred embodiments, the pinning configurations provide additional structural strength and safety. Additional structural strength over conventional designs is provided by using the pins to fix the hydraulic cylinder 48 sections to the boom sections 46, rather than using a single pin for a pivotal connection. While a pivotal connection does not allow bending stresses applied to the boom sections 46 to be partly transferred to the hydraulic cylinder 48 sections, the pinned connections provided by the preferred embodiments effectively transfer such stresses, thereby significantly increasing structural strength. Further, pin removal may not occur until binding pressure is relieved. Accordingly, the likelihood of inadvertent pin removal is minimal.

As shown in FIG. 10, one or more wheels 12 for each of the bases 14 can be driven by a motor 82. It will be apparent to one skilled in the art that an alternative drive structure can be used. The motors 82 are preferably controlled by a central control panel 84. Because the motors 82 are difficult to synchronize perfectly, and because one side of the gantry 10 may encounter greater resistance to movement, means for stabilizing the gantry 10 to prevent structural failure are desirable.

As shown in FIGS. 2 and 12–21, a stabilizer bar assembly constructed in accordance with one form of the invention is indicated at 100. The stabilizer bar assembly 100 has a lower end 102 attached to the manual section 24 and an upper end 104 attached to the beam 18 as shown in FIG. 12. The ends of the stabilizer bar assembly 100 are shown as being connected to the manual section 24 and the beam 18 by means of bolts 106 and rectangular plates 108. This connection technique enables the operating angle 109 to be varied as desired. However, it will be apparent to one skilled in the art that other conventional connecting techniques can be used, including welding, pinning or other techniques which may or may not fix the operating angle 109.

A lower mounting bracket 110 is connected to the manual section 24 by means of bolts 106 and rectangular plates 108 as illustrated in FIG. 12. Though a conventionally pinned connection can be used, preferably the lower mounting bracket 110 is also connected to the shaft 116 through the use of a swivel bearing 114. The swivel bearing 114 allows slight deviations from a starting position corresponding to a perpendicular relationship between the beam 18 and the manual section 24. The shaft 116 is contained within the barrel 118 and is held in place within the barrel 118 by a first spring 120 and a second spring 122 contacting a plate 123 welded to the shaft 116. The upper end 124 of the barrel 118 is connected to a swivel bearing 114 as well.

The first spring 120 is the first spring contacted by the plate 123 on the shaft 116. The spring rate of the first spring 120 is selected so that preferably 700 pounds of restoring force are provided in the first inch of deviation from a starting position. The starting position is a point at which the beam 18 and the manual section 24 are perpendicular to one another along two axes. As further deviation occurs, the shaft 116 contacts the second spring 122 as well. This increases the total force to approximately 12,000 pounds of restoring force as shown in FIG. 22. In this way, minor deviations which can result from one end of the gantry 10 moving slightly farther than the other in a direction of travel can be rectified before structural instability or failure might result. Further, the load on the beam 18 is more evenly distributed through the use of the stabilizer bar assemblies 100 transferring part of the load and strengthening the connection between the beam 18 and the manual section 24.

Figure 13:
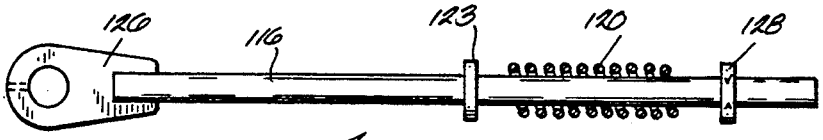
FIG. 13 is a side elevation view of a shalt mechanism for a single spring embodiment of a stabilizer bar assembly constructed in accordance with one form of the invention.
Figure 14:
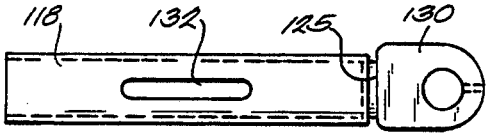
FIG. 14 is a side elevation view of a barrel mechanism for use with the single spring stabilizer assembly shown in FIG. 13.

A preferred embodiment of one form of the invention is illustrated in FIGS. 13–15. It will be apparent to one skilled in the art that although components having the dimensions specified herein have been shown to perform satisfactorily, the dimensions of the components of the stabilizer bar assembly 100 can be readily modified as required by any particular application. As illustrated in FIG. 13, a 1.75" diameter shaft 116 is coupled to a lower clevis 126. The lower clevis 126 can be coupled to the manual section 24 in a number of conventional ways as discussed previously. Although various connection methods can be used, swivel bearings can be inserted into clevises and conventional mechanical structures can be affixed thereto to provide a pivoting connection in the embodiments described herein. Such bearings are commercially available from the RBC of West Trenton, N.J., as the B-EL Series of Self-Aligning Radial Bushings. Preferably, however, a swivel bearing 114 is inserted into the lower clevis 126 as shown in FIG. 15. A set screw 127 can be inserted into a hole 129 in the lower clevis 126 to retain the bearing 114 therein. A sliding first plate 123 is produced with hole slightly larger than the diameter of the shaft 116. This allows the sliding first plate 123 to be slideably connected to the shaft 116 opposite where it is coupled to the lower clevis 126. Next, a first spring 120 is placed on the shaft 116. A $\frac{3}{8}$"×4.5" steel second plate 128 is then welded to retain the first spring 120 on the shaft 116 as shown in FIGS. 13 and 15. A third spring 134 is then placed on the shaft 116 adjacent the second plate 128 as shown in FIG. 15.

As illustrated in FIG. 14, a barrel 118 is connected to an upper clevis 130 by welding both to a backer plate 125. The upper clevis 130 can be coupled to the beam 18 in conventional ways discussed previously, though preferably a swivel bearing 114 is connected to the upper clevis 130 to allow pivoting movement. While various barrel sizes and materials can be used equivalently, preferably a steel barrel 118 about 22" long, having an inner diameter of approximately 3.438"and an outer diameter of about 4"is used. The barrel 118 is also provided with a ¾" wide slot 132 which extends for 8" along one side of the barrel 118. The slot 132 allows the operator to see the springs 120, 124 and their relative positions in the barrel 118. One or more bolts 106 can be inserted into the springs 120, 122 to allow the operator to readily observe when the stabilizer bar assembly 100 has been moved to an off-center position. This indicates a nonperpendicular configuration of the beam 18 and the manual section 24 of the boom.

FIG. 15 illustrates the assembly of the components shown in FIGS. 13 and 14. As shown, the barrel I 18 is sized so as to fit over the shaft 116, spring 120, 122 and plate 123, 125, 128 structures. The sliding first plate 123 is welded to the barrel 118 during assembly, and the first spring 120 is mounted over the shaft 116 between the sliding first plate 123 and the welded second plate 128. The second spring 122 is located between the backer plate 125 and the welded second plate 128. Accordingly, stretching or shortening of the stabilizer bar assembly 100 is resisted by the springs 120, 122 engaging the plates 123, 125 and/or 128.

In use, the sliding plate 123, 128 acts as a guide for the shaft 116 as it extends and contracts in the barrel 118, as well as providing a support structure for the spring 120, 122 to bear against for resisting extension of the shaft 116. Though various springs can be used equivalently, preferably a coil spring having a fully loaded compressed capacity of approximately 4,000 pounds is used.

Figure 18:
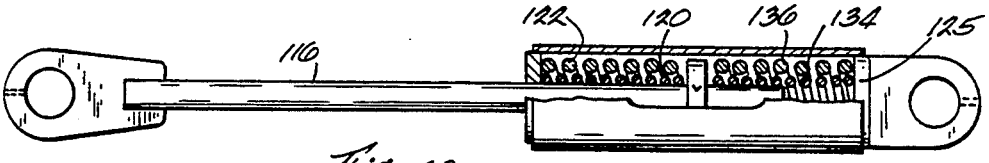
FIG. 18 is a side elevation view of a stabilizer bar constructed by assembling the components shown in FIGS. 16 and 17.
Figure 16:
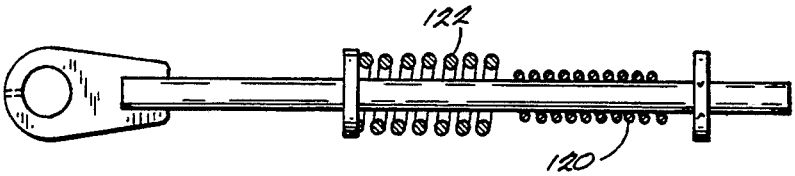
FIG. 16 is a side elevation view of a dual spring embodiment of a stabilizer bar assembly constructed in accordance with one form of the invention.
Figure 17:
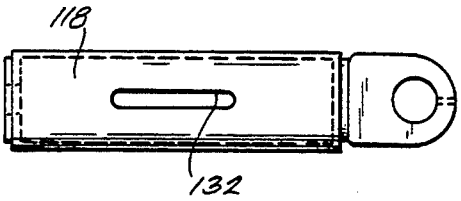
FIG. 17 is a side elevation view of a barrel assembly for use with the twin spring shaft shown in FIG. 16.
Figure 21:
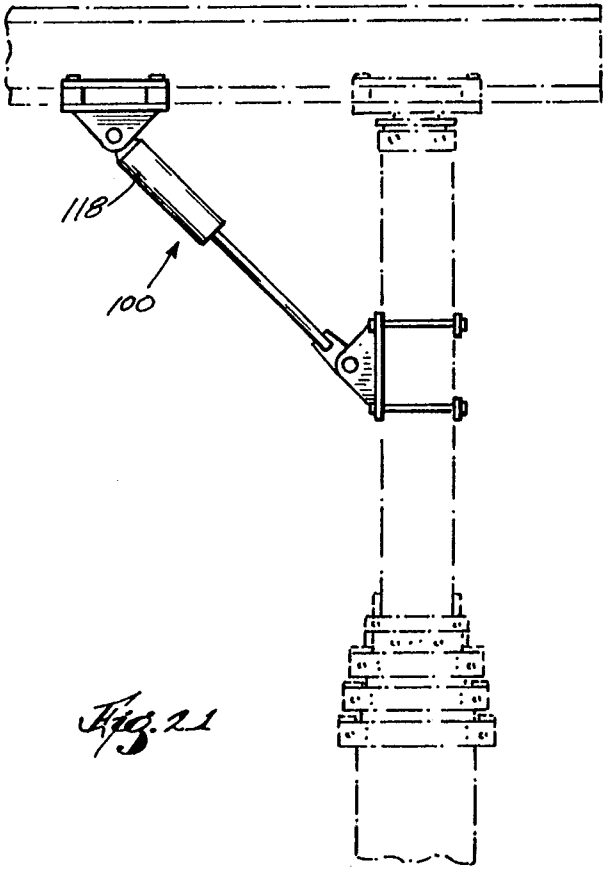
FIG. 21 is a side elevation view of a stabilizer bar in a variable angle configuration shown attached to an extendible boom gantry.
Figure 20:
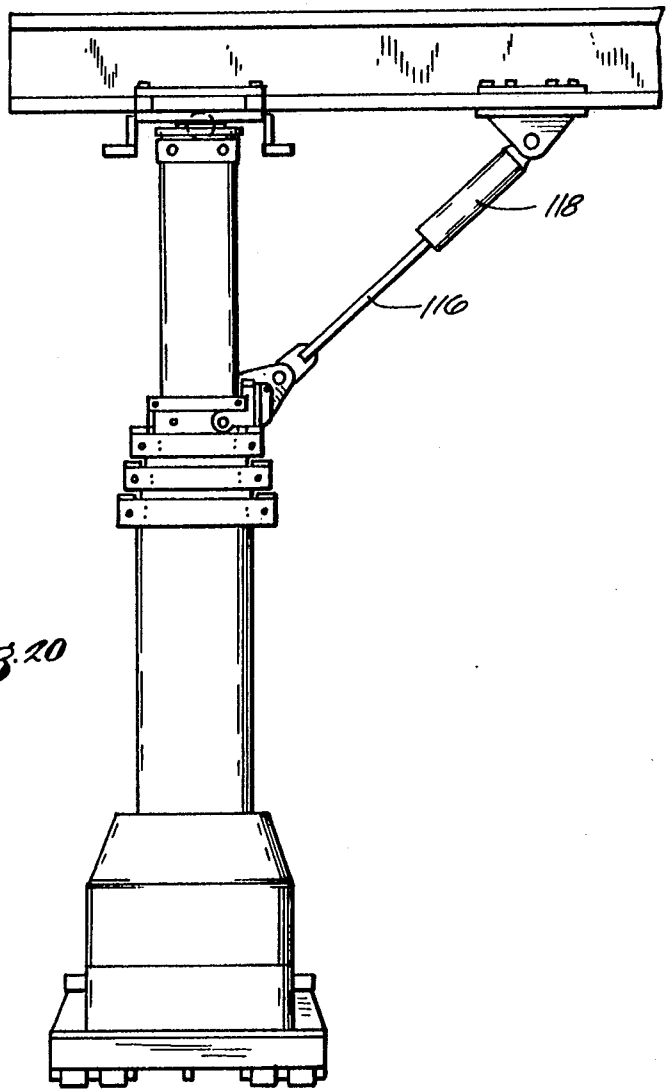
FIG. 20 shows a side elevation view of a boom gantry having a stabilizer bar constructed in accordance with one form of the invention installed in a fixed angle configuration.

Referring to FIGS. 16–18, a dual spring embodiment of one form of the invention is illustrated. In this embodiment, a first spring 120 having a diameter slightly greater than that of the shaft 116 is disposed within a larger second spring 122. The third spring 134 is disposed within a fourth spring 136. One set of springs is provided between the first plate 123 which is welded to the barrel 118 and the second plate 128 welded to the shaft 116. The other set of springs is mounted on the shaft 116 between the second plate 128 and the upper end of the barrel 118. Varying spring rates can be selected for each of the springs.

The first spring 120 and the third spring 134 can be selected so they are slightly longer than the larger second spring 122 or fourth spring 136. This gives two-step progressive resistance, as is shown FIG. 22. In this embodiment, deviation from a perpendicular configuration of the beam 18 and the manual section 24 causes the second plate 128 to initially contact only the first spring 120. As deviation increases, the first spring 122 is compressed and the second plate 128 contacts the second spring which dramatically increases the resistance to further deviation. Deviation in the opposite direction actuates the third spring 134 and the fourth spring 136 in a similar manner.

While a particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

What is claimed:

1. A gantry comprising:

a pair of spaced, wheeled bases;

a pair of vertically extendible columns extending upwardly from said bases in substantially parallel relation to each other, each of said columns having upper end;

a substantially horizontal beam extending been said upper ends of said vertically extendible columns; and a pair of stabilizer bars, each extending diagonally between said beam and an adjacent one of said upper ends of said vertically extendible columns;

each of said stabilizer bars comprising a barrel, a shaft within said barrel and a pair of coaxially oriented coil springs within and engaging said barrel and encircling said shaft;

said coil springs providing a first retaining force when said shaft is displaced between a starting position and first displaced position and a second greater retaining force when said shaft is displaced beyond said first displaced position such that said stabilizer bar substantially permits angular movements between said beam and said vertically extendible column that are insufficient to displace said shaft beyond said first displaced position and such that said stabilizer bar substantially resists angular movements between said beam and said vertical extendible column that displace said shaft beyond said first displaced position.

2. A gantry as defined in claim 1 wherein at least one of said coil springs is dimensioned to fit substantially within another one of said coil springs.

3. A gantry as defined in claim 2 wherein at least one of said coil springs is longer than at least another one of said coil springs.

4. A gantry as defined in claim 3 wherein said barrel substantially comprises a cylindrical housing.

5. A gantry as defined in claim 4 wherein said stabilizer bars are pivotably coupled to said columns and said beam by a pivotable coupling.

6. A gantry as defined in claim 5 wherein said pivotable coupling comprises a spherical bearing.

7. A gantry as defined in claim 6 wherein said spherical bearing allows minor deviation from the starting position while maintaining structural integrity of the gantry.

8. A gantry as defined in claim 7 wherein said starting position corresponds to a perpendicular orientation of said beam and said columns.

* * * * *